United States Patent [19]

Yamada

[11] Patent Number: 4,898,414

[45] Date of Patent: Feb. 6, 1990

[54] WATER-TIGHT, NOISE-PROOF SEALED TYPE LOCKING APPARATUS FOR AUTOMOBILES

[75] Inventor: Shinjiro Yamada, Utsunomiya, Japan

[73] Assignee: Mitsui Kinzoku Kogyo Kabushiki Kaisha, Tokyo, Japan

[21] Appl. No.: 252,920

[22] Filed: Oct. 4, 1988

[30] Foreign Application Priority Data

Oct. 31, 1987 [JP] Japan ..... 62-276409

[51] Int. Cl.[4] ..... E05C 3/26

[52] U.S. Cl. ..... 292/337; 292/201; 292/DIG. 38; 292/216

[58] Field of Search ..... 292/1, 201, 216, 280, 292/337, DIG. 38

[56] References Cited

U.S. PATENT DOCUMENTS

| | | | |
|---|---|---|---|
| 3,504,511 | 4/1970 | Allen | 292/216 X |
| 4,518,182 | 5/1985 | Cousin et al. | 292/216 X |
| 4,735,447 | 4/1988 | Kleefeldt | 292/216 |
| 4,779,912 | 10/1988 | Ikeda et al. | 292/201 X |

*Primary Examiner*—Richard E. Moore

*Attorney, Agent, or Firm*—Browdy and Neimark

[57] ABSTRACT

The water-tight, noise-proof sealed type locking apparatus of this invention has recesses formed in the body 5. In the recess 15 formed on the front side of the body 5 a latch 13 and a rachet 14 are installed; in the recess 16 formed on the back side of the body 5 rotation control members for the rachet 14 is installed. The front of the body 5 is covered with a cover plate 6 and the back with a back plate 7. Wires connected to the rotation control members are fitted water-tightly to the body 5.

2 Claims, 2 Drawing Sheets

WATER-TIGHT, NOISE-PROOF SEALED TYPE LOCKING APPARATUS FOR AUTOMOBILES

FIELD OF THE INVENTION

This invention relates to an automotive locking apparatus and more particularly to a water-tight, noise-proof sealed type locking apparatus.

PRIOR ART

A general, conventional automotive locking apparatus has the following structure: a metal cover plate is mounted to the front of the synthetic resin body; a metal back plate is mounted to the back of the synthetic resin body; a latch and a rachet to prevent reverse rotation of the latch are installed in a recess between the body and the cover plate; and an open lever and a lock lever are installed in a space between the body and the back plate and on the outside of the back plate to control the rotation of the rachet.

In the known apparatuses most of the rotation control members mounted on the back plate are exposed, so that there are the following problems:

(1) rain water may run along the wires and rods connected to rotation control members and reach the rotation control members which will be rusted. During winter, the water that entered rotation control members may freeze, leading to the operation failure of the members; and (2) the operation noise of rotation control members will be heard relatively loudly even in the car.

OBJECT OF THE INVENTION

The object of the invention is to provide a water-tight, noise-proof sealed type locking apparatus which overcomes the above problems and which protects against theft and prevents the door from opening at time of a clash.

DETAILED DESCRIPTION OF THE INVENTION

Figure 1:
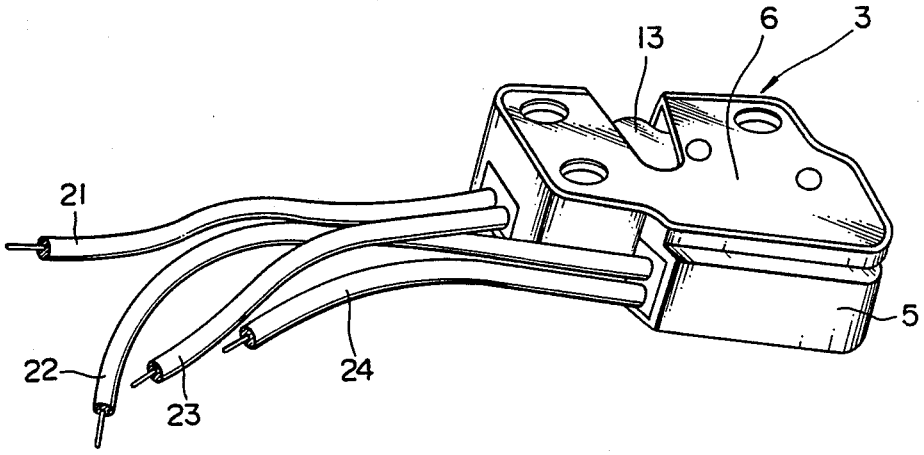
FIG. 1 is a perspective view of an embodiment of this invention.
Figure 2:
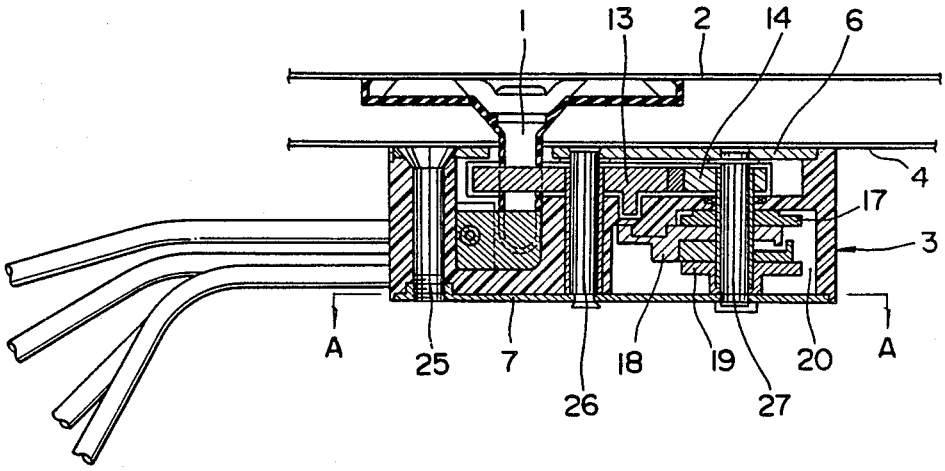
FIG. 2 is a longitudinally cross-sectioned side view of the embodiment.
Figure 3:
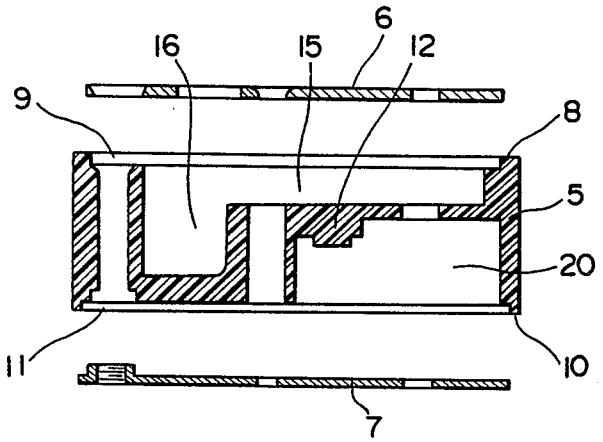
FIG. 3 is a cross-sectional view of a body, a cover plate and a back plate.

One embodiment of the invention will be explained in the following by referring to the attached drawings.

A striker 1 is mounted to the car body 2 and a lock body 3 is mounted on the door 4. The lock body 3 has a synthetic resin body 5, a cover plate 6 mounted to the front of the body 5, and a back plate 7 mounted to the back of the body 5. The cover plate 6 is installed in a recess 9 formed at the front 8 of the body 5 and the back plate 7 is installed in a recess 11 formed at the back 10 of the body 5.

Between the front 8 and the back 10 of the synthetic resin body 5 is provided a partition wall 12, in front of which there are formed a recess 15 for accommodating a latch 13 and a rachet 14 and a recess 16 into which the striker 1 advances. On the back 10 side of the partition wall 12 a recess 20 is formed to accommodate a first open lever 17, a second open lever 18 and a locking lever 19.

Reference numeral 21 denotes a wire running from a locking lever 19 to the sill knob on the door; 22 a wire leading from the second open lever 18 to the inner handle on the door; 23 a wire leading from the first open lever 17 to the door key; and 24 a wire leading from the first open lever 17 to the outer handle on the door. All these wires are connected to the synthetic resin body 5 water-tightly.

The cover plate 6 and the back plate 7 are securely connected together by means of a screw 25, a center shaft 26 of the latch 13 and a center shaft 27 of the rachet 14.

Figure 4:
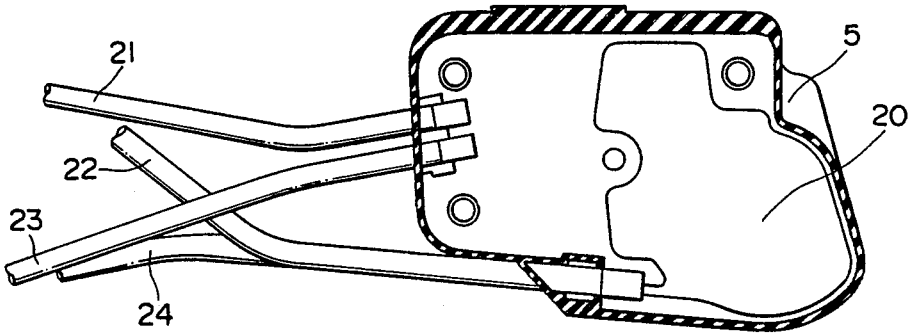
FIG. 4 is a cross-sectional view taken along the line A—A of FIG. 2.

Although this invention is similar to the prior art in that the recess 15 for accommodating the latch 13 and the rachet 14 and the recess 16 for accepting the striker 1 are formed on the front 8 side of the body 5, it significantly differs from the prior art in that a recess 20 is formed on the back 10 side of the body 5 to accommodate rotation control members for the rachet 14 including the first open lever 17, the second open lever 18 and the locking lever 19. Since the recess 20 is covered by the back plate 7, the assembled lock body 3 looks like a plain box with no projections, as shown in FIG. 4.

Advantages

As explained above, since in this invention the latch 13 and the rachet 14 as well as the rotation control members for the rachet 14 are installed in the recesses formed in the body 5 which are covered by the cover plate 6 and the back plate 7 and since wires connected to the rotation control members are attached to the body 5 water-tightly, the following advantages are obtained.

(1) Rain water will not enter the rotation control members through the wires and rods connected to the rotation control members.

(2) Operation noise of the rotation control member will not leak into the car.

(3) The rotation control members cannot be tampered with from outside (for prevention of theft).

I claim:

1. A water-tight, noise-proof sealed type locking apparatus comprising:

a synthetic resin body;

a partition wall formed medially of the synthetic resin body;

a first recess formed in the body on the front side of the partition wall to accommodate a latch and a rachet; and a second recess formed in the body on the back side of the partition wall to accommodate rotation control members, the rotation control members including an open lever and a locking lever;

whereby the first recess is covered by a cover plate, the second recess is covered by a back plate, and a connecting member for connecting the rotation control members to a handle on a door is fitted water-tightly to the synthetic resin body.

2. A locking apparatus according to claim 1 wherein said partition wall is formed at the center of said synthetic resin body.

* * * * *